US005308450A

United States Patent [19]

Braun et al.

[11] Patent Number: 5,308,450

[45] Date of Patent: May 3, 1994

[54] PRESS SECTION OF A PAPERMAKING MACHINE

[75] Inventors: Heinz Braun, Ravensburg; Peter Mirsberger, Berg, both of Fed. Rep. of Germany

[73] Assignee: Sulzer Escher Wyss GmbH, Ravensburg, Fed. Rep. of Germany

[21] Appl. No.: 868,688

[22] Filed: Apr. 15, 1992

[30] Foreign Application Priority Data

Apr. 16, 1991 [DE] Fed. Rep. of Germany ..... 4112355

[51] Int. Cl.[5] ..... D21F 3/04

[52] U.S. Cl. ..... 162/360.2; 162/358.3; 162/359.1; 162/360.3

[58] Field of Search ..... 162/358.3, 360.2, 360.3, 162/359.1, 193

[56] References Cited

U.S. PATENT DOCUMENTS

| | | | |
|---|---|---|---|
| 3,861,996 | 1/1975 | Dorfel | 162/360.3 |
| 4,163,688 | 8/1979 | Kankaanpaa | 162/359.1 |
| 4,197,158 | 4/1980 | Johnson | 162/360.3 |
| 4,257,844 | 3/1981 | Schmitt et al. | 162/305 |
| 4,551,203 | 11/1985 | Eskelinen | 162/207 |
| 4,915,790 | 4/1990 | Dahl | 162/360.2 |
| 4,988,410 | 1/1991 | Meinecke et al. | 162/360.3 |

FOREIGN PATENT DOCUMENTS

| | | |
|---|---|---|
| 289477 | 11/1988 | European Pat. Off. . |
| 3604522 | 9/1986 | Fed. Rep. of Germany . |
| 3729723 | 3/1988 | Fed. Rep. of Germany . |
| 3705241 | 7/1988 | Fed. Rep. of Germany . |
| 8717279 | 8/1988 | Fed. Rep. of Germany . |
| 3742848 | 6/1989 | Fed. Rep. of Germany . |
| 3815278 | 11/1989 | Fed. Rep. of Germany . |
| WO88/08051 | 10/1988 | World Int. Prop. O. . |

OTHER PUBLICATIONS

Mirsberger, Peter, "Schuhpressen zum intensiven Entwassern von Papier und Karton", *Das Papier*, vol. 43, No. 10A, Oct. 1989, pp. 130–138.

*Primary Examiner*—Karen M. Hastings
*Attorney, Agent, or Firm*—Sandler, Greenblum & Bernstein

[57] ABSTRACT

The press section of a papermaking machine for dewatering a paper web comprises two separate, successively arranged extended nip press locations. Both of the extended nip press locations contain at least one respective felt which travels together with the paper web through the associated extended nip press location. The paper web is guided from the first extended nip press location to a web removal device contacted by an upper felt of the second extended nip press location, and from that location the paper web can move to the second extended nip press location.

18 Claims, 4 Drawing Sheets

PRESS SECTION OF A PAPERMAKING MACHINE

BACKGROUND OF THE INVENTION

1. Field of the Invention

The present invention relates to a new and improved press section of a papermaking machine for pressing and dewatering a paper web.

Generally speaking, the press section of a papermaking machine for dewatering a paper web, as contemplated by the present development, is of the type comprising two separate successively arranged press locations. Each press location is formed between an upper extended press surface and a lower extended press surface forming extended or wide press nips. The press section contains at the first press location and at the second press location at least one respective separate felt guided in conjunction with the paper web through the press locations. The second press location contains a cylindrical counter roll or roller extending essentially beneath the second press location and an extended nip press roll extending essentially above the second press location. This extended nip press roll forms the extended nip of the second pres location and is essentially accommodated to the contour of the counter roll.

2. Discussion of the Background and Material Information

Press sections or press arrangements of the aforementioned type for pressing and dewatering a paper web possess the decisive advantage that by using press structures which, as viewed in the direction of travel of the paper web, have an extended or wide press length, that is, an extended press nip, there is available a relatively large amount of time for expressing liquid out of the paper web. As a result, such a press section can operate with relatively few press locations and nonetheless can achieve a high dewatering effect or capacity even with relatively rapid throughpass or high speed travel of the paper web. The presently known press apparatuses or arrangements containing an extended press nip are frequently constructed such that there is provided a press roll equipped with a flexible shell or jacket which is pressed from internally of the press roll by means of an essentially only radially movable press element against a rigid counter roll, and the flexible shell or jacket, at the region of the extended press nip, can snugly bear against the rigid counter roll. However, other constructions are possible for achieving an extended press nip or press surface.

In order to obtain as great as possible operational reliability of the press section, at high speed papermaking machines it is strived to continuously maintain the paper web in contact with at least one felt, in order to thus avoid a so-called free or open draw where the paper web would be exposed to the danger of tearing. What is disadvantageous with such arrangements is especially that, following departure of the paper web from the press nip, there occurs remoistening or rewetting of the paper web by the water entrained by the felt.

In the commonly assigned German Published Patent Application No. 3,742,848, published Jun. 29, 1989, and the cognate U.S. Pat. No. 4,915,790, granted Apr. 10, 1990, there is disclosed an arrangement intended to solve the aforementioned problem, wherein special measures are undertaken in order to raise at least one felt very rapidly away from the paper web after the latter emerges from the press nip.

Furthermore, solutions have become known in the papermaking art where only a single felt is present in the second press nip. If this felt is located at the top of the paper web, then such paper web can drop off such felt much too easily prior to entering the second press location or press nip. On the other hand, if such felt is located at the bottom of the paper web, especially in the form of a continuous felt which spans both press locations or press nips, then the paper web co-travels throughout its full width, following exit from the second press location or press nip, upwardly together with the top or upper roll, and is then difficult to handle. Moreover, at this location there also exists a greater tendency of the paper web to again suck up water from the felt behind the press nip.

German Published Patent Application No. 3,815,278, published Nov. 16, 1989, discloses a press arrangement containing two successive roll presses each provided with an extended press nip. While here there exist favorable conditions for dewatering the paper web, on the other hand, the paper web is transported by one felt through both roll presses or press locations. It is not possible to condition the paper web between both of the roll presses.

SUMMARY OF THE INVENTION

Therefore, with the foregoing in mind, it is a primary object of the present invention to provide an improved press section or press arrangement of a papermaking machine for pressing and dewatering a paper web, which is not afflicted with the aforementioned limitations and drawbacks of the prior art.

Another and more specific object of the present invention aims at improving upon the dewatering effect or capacity of press sections containing two successively arranged extended or wide press nips, without impairing the operational reliability as concerns guiding the paper web through both extended or wide press nips.

Still a further noteworthy object of the present invention is directed to the provision of an improved press section or press arrangement of a papermaking machine for pressing and dewatering a paper web, which is relatively simple in construction an design and exceedingly reliable and efficient in operation.

Now in order to implement these and still further objects of the present invention, which will become more readily apparent as the description proceeds, the press section of the present development for dewatering a paper web is manifested, among other things, by the features that behind or downstream of the first press location, as viewed in the predetermined direction of travel of the paper web, the upper felt—to the extent present—of the first press location is removed or separated from the paper web located beneath such upper felt, thereafter the paper web is further guided from the first press location to a web removal or pickup device operated under vacuum conditions and contacted by the upper felt of the second press location, and the paper web can travel from such web removal or pickup device to the second press location.

A particular advantage which is realized with the solutions proposed by the present invention resides in the fact that different felts or felt belts are used in each case for both of the press locations. Therefore it is possible to newly condition each felt or felt belt following passage thereof through the associated press location, in other words, it is possible to make each such felt or felt belt available with a relatively low water content for accomplishing a new pressing operation at the paper web. The transfer of the paper web from the first lower felt to the second upper felt is performed with the aid of a felted and vacuum-operated web removal or pickup device. There is also ensured that the wet or moist paper web is positively guided between the first and second press locations and can be retained at the felt.

According to a further feature of the present invention, the at least one separate felt provided for the first press location and guided in conjunction with the paper web through the first press location defines a lower felt, and the paper web is transferred by the lower felt of the first press location to the vacuum-operated web removal device which is contacted by the upper felt of the second press location.

According to another aspect of the present invention, the web removal device is advantageously located between the first press location and the second press location, and the substantially cylindrical counter roll of the second press location defines a lower counter roll. The paper web is transferred by such web removal device, after moving through at most a substantially short travel distance, into contact with the lower counter roll of the second press location and then the paper web is guided in conjunction with the upper felt through the second press location.

Still further, there can be specifically provided an upper felt for the first press location, and the web removal device directly removes the paper web from the first press location. Also, in this regard there can be provided a lower counter roll for the first press location, and the web removal device directly removes the paper web from such lower counter roll.

Moreover, a vacuum-operated suction box can be located above the upper felt of the second press location for transferring the paper web between the web removal device and the lower counter roll of the second press location. The paper web is transferred by the web removal device located between the first press location and the second press location to the upper felt of the second press location and then to the lower counter roll of the second press location such that the suction box retains the paper web against the upper felt of the second press location.

According to a further embodiment, a transport wire is located beneath the upper felt of the second press location and the paper web for transferring the paper web between the web removal device and the lower counter roll of the second press location. The paper web is transferred by the web removal device located between the first press location and the second press location to the upper felt of the second press location and then to the lower counter roll of the second press location such that the transfer belt retains the paper web against the upper felt.

A further design envisions that a blow box is located above the paper web for transferring the paper web between the web removal device and the lower counter roll of the second press location. This blow box directs an air current in a direction away from the upper felt of the second press location. The paper web is transferred by the web removal device located between the first press location and the second press location to the upper felt of the second press location and then to the lower counter roll of the second pres location such that the blow box retains the paper web against the upper felt. This blow box can comprise slot means, and thus, constitutes a slotted blow box for producing an injector action which directs the air current in the direction away from the upper felt.

Another feature of the present invention contemplates arranging an additional web removal device downstream of the second press location with respect to the direction of travel of the paper web, and a further upper felt cooperates with the additional web removal device A suction box operated under vacuum conditions is arranged above this further upper felt. The additional web removal device guides the paper web, following the second press location, at the further upper felt such that the suction box retains the paper web against the further upper felt.

According to a further modification of the present invention, a blow box is arranged above the further upper felt, this blow box directs an air current in a direction away from the further upper felt. The additional web removal device guides the paper web, following the second press location, at the further upper felt such that the blow box retains the paper web against the further upper felt. Once again, such blow box can comprise slot means to define a slotted blow box for producing an injector action which directs the air current in the direction away from the further upper felt.

Still further, the first press location can contain a substantially cylindrical counter roll extending beneath the first press location and an extended nip press roll extending above the first press location. This extended nip press roll forms the extended nip of the first press location and is essentially accommodated to the contour of the substantially cylindrical counter roll of the first press location.

Moreover, the successively arranged first press location and second press location can be positioned at substantially the same elevation or height.

According to a further embodiment, the substantially cylindrical counter roll of the second press location defines a lower counter roll, and an additional web removal device is arranged downstream of the second press location with respect to the direction of travel of the paper web. There also are provided means for providing a web drying section arranged downstream of the additional web removal device. A further upper felt cooperates with the additional web removal device. The upper felt of the second press location is guided, following passage through the second press location, such that it detaches from the paper web which remains adhering to the lower counter roll. Moreover, the additional web removal device removes the paper web from the lower counter roll and transfers the removed paper web to the drying section.

Furthermore, this additional web removal device which cooperates with the further upper felt can be advantageously mounted to be pivotable towards and adjustable in position with respect to the lower counter roll.

Still further, the drying section can be structured to provide a continuous closed guidance or closed draw guidance of the paper web through the drying section.

It is also possible to arrange a waste or broke pulper or the like beneath the second press location for collecting and forming a suspension therein from broke or paper web material formed upon tearing or transfer of the paper web.

According to another aspect, the press section can be devoid of means upstream of the second press location for forming transfer tails, so that transfer of the paper web through the first press location and the second press location occurs throughout the full width of the paper web.

It is also possible to have means arranged downstream of the first press location for removing or separating the upper felt of the first press location from the paper web in order to prevent rewetting or remoistening of the paper web.

BRIEF DESCRIPTION OF THE DRAWINGS

The invention will be better understood and objects other than those set forth above, will become apparent when consideration is given to the following detailed description thereof. Such description makes reference to the annexed drawings wherein there have been generally used throughout the different figures the same reference characters to denote the same or analogous components or parts, and wherein.

DETAILED DESCRIPTION OF THE PREFERRED EMBODIMENTS

Describing now the drawings, it is to be understood that only enough of the construction of the different exemplary embodiments of press sections of a papermaking machine for pressing and dewatering a paper web has been depicted therein, in order to simplify the illustration, as needed for those skilled in the art to readily understand the underlying principles and concepts of the present invention.

Figure 1:
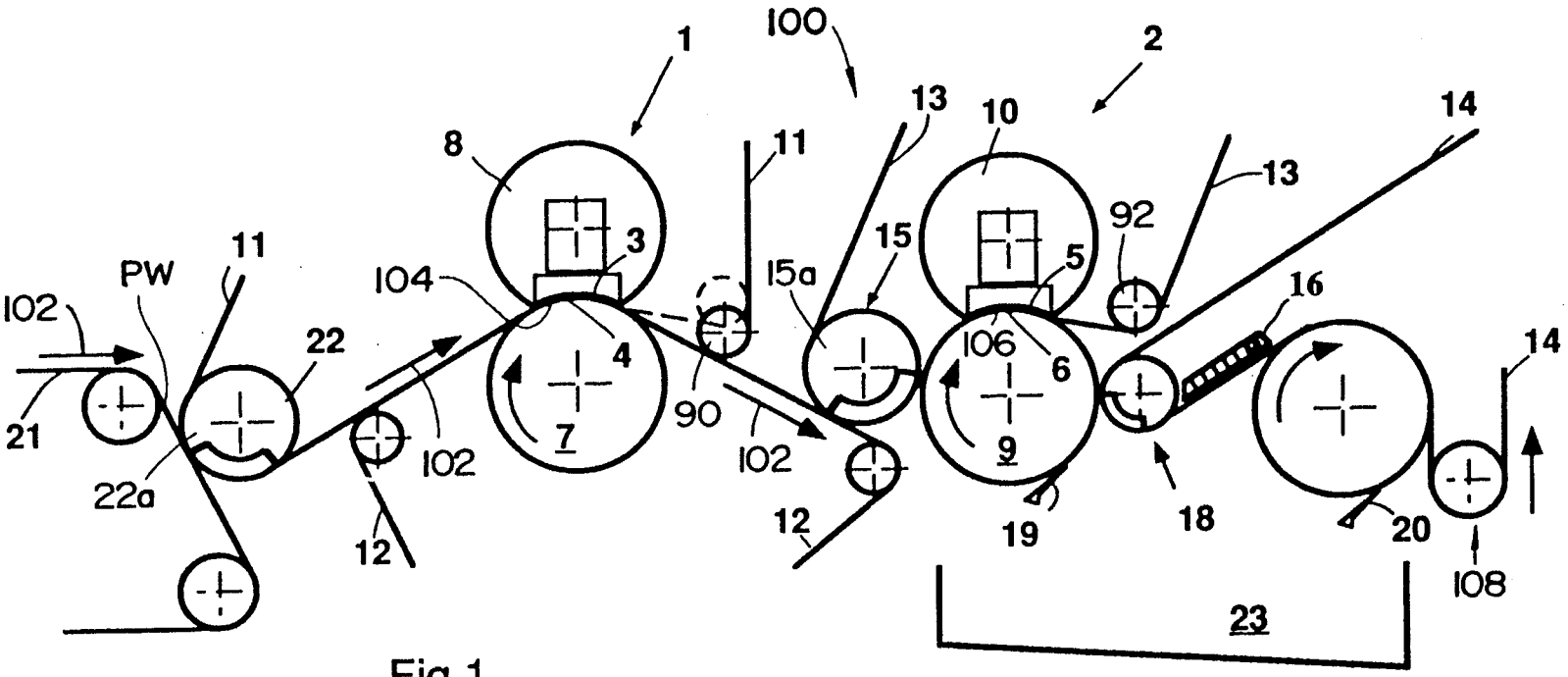
FIG. 1 is a schematic side view of a first exemplary embodiment of a press section of a papermaking machine for pressing and dewatering a paper web, containing first and second press locations.

Turning attention to the first exemplary embodiment of press section 100 of a papermaking machine as depicted in FIG. 1, it will be seen that a paper web, only generally indicated by reference character PW, is delivered, for instance, by a longitudinal wire 21 through a pickup roll 22, such as a suction roll 22*a*, into the press section 100. This press section 100 is here shown to comprise two successively arranged press locations 1 and 2, defining a first press location 1 and the downstream situated second press location 2 as viewed with respect to a predetermined direction of travel 102 of the paper web PW through the press section 100.

It will be see that the first press location 1 comprises press surfaces 3 and 4, and equally, the second press location 2 comprises press surfaces 5 and 6. It also will be recognized, as viewed in the direction of travel 102 of the paper web PW, the press surfaces 3 and 4 of the first press location 1 and the press surfaces 5 and 6 of the second press location 2 each have an extended shape, to thus define the respective extended or wide press nips 104 and 106. In the exemplary embodiment under discussion the first and second press locations 1 and 2 comprise the respective lower situated counter rolls 7 and 9 and the respective upper situated extended nip press rolls 8 and 10. Moreover, as depicted solely by way of example, the successively arranged first press location 1 and the second press location 2 can be positioned at substantially the same elevation or height.

At the site of the first press location 1 there are here shown to be used two looped or endless felts or felt belts 11 and 12 which travel conjointly with the paper web W sandwiched therebetween through the first press location 1. It will be observed that the upper felt is trained about a displaceable deflection or turning roll 90. It is here also noted that under certain circumstances the upper felt 11 might even be omitted. Regarding the second press location 2, only a single looped or endless felt or felt belt 13 is guided through such second press location 2. The removal or pickup of the paper web PW from the lower felt 12 is undertaken by a web removal or pickup device 15, here constructed, for instance, as a suction or vacuum roll 15*a* about which partially wraps upper felt 13.

The paper web PW which is lifted or picked off from the lower felt 12 by the web removal device 15 is delivered through a short travel path or while in direct contact with the suction roll 15*a* to the lower counter roll 9 of the second press location 2, so that there is practically precluded dropping of the paper web PW due to its weight off of the upper felt 13 of the second press location 2. Behind or downstream of the extended or wide press nip 106, as viewed with respect to the direction of travel 02 of the paper web PW, such paper web PW remains adhering to the lower counter roll 9, whereas the upper felt 13 travels over a deflection or turning roll 92 and is raised away from the paper web.

By means of a further web removal or pickup device 18, here constructed, for instance, as a suction roll 18*a* which can be shifted or displaced towards the lower counter roll 9, the paper web PW is deposited at a further upper looped or endless felt or felt belt 14 and then moves in conjunction therewith to the starting region of a subsequently arranged web drying section, generally indicated by reference numeral 108, of the papermaking machine. In the event that the paper web tears or during transfer in the case of start-up of the papermaking machine, the not further transported paper web or paper web strips can be deposited with the assistance of doctor blades or scrapers 19 and 20 into the waste or broke pulper or receiver 23 or the like without any problems arising.

A further advantage can be realized if upon start-up of the press section 100 the paper web PW can be guided in its full width through the first and second press locations 1 and 2, because that measure serves to protect the sometimes sensitive structural parts of the extended nip press rolls 8 and 10. When the paper web PW then departs from the last extended nip press roll there can be formed a transfer tail or strip, for instance for the subsequently situated drying section. The thus formed waste or broke is deposited in the below situated waste or broke pulper 23. More specifically, in such waste or broke pulper 23 which is arranged beneath the second press location 2 there is formed a suspension from the collected broke or paper web material resulting during tearing or transfer of the paper web.

Figure 2:
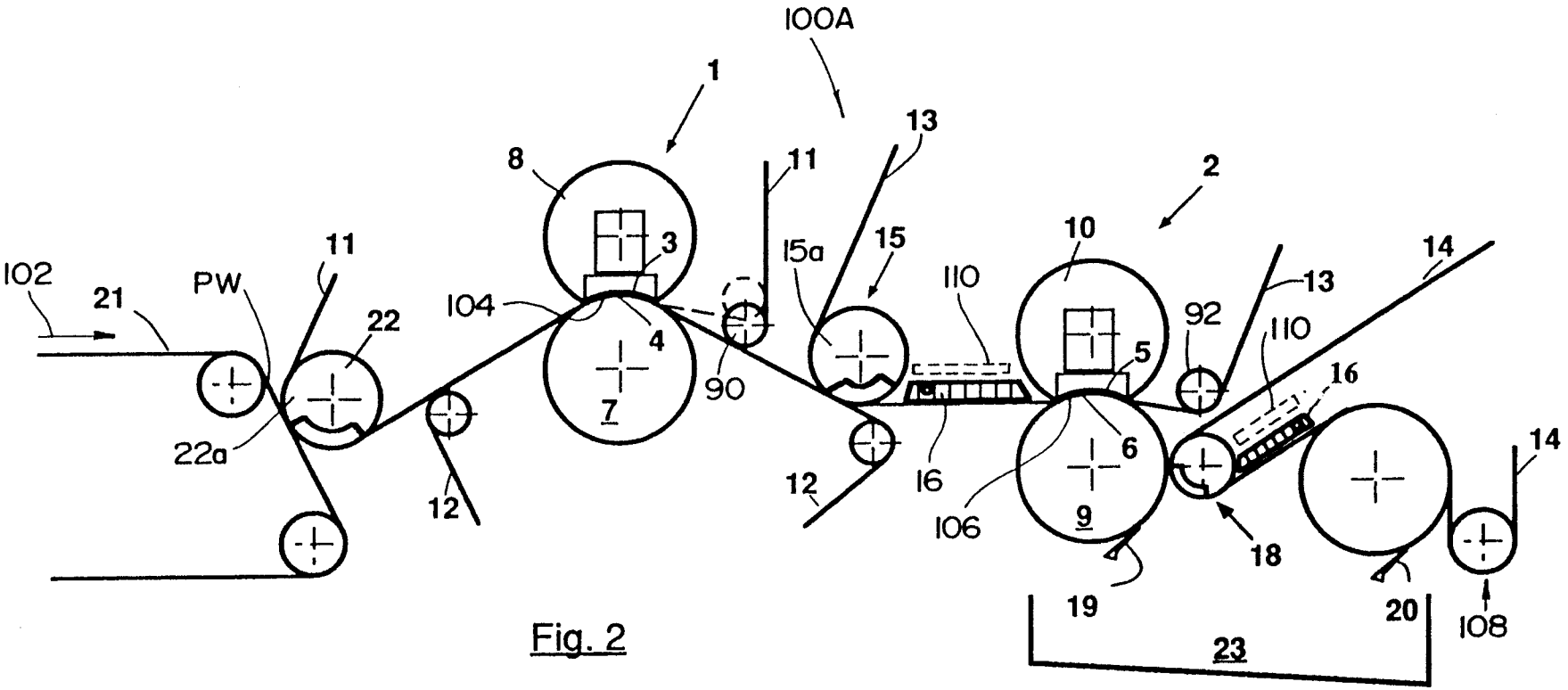
FIG. 2 is a schematic side view of a second exemplary embodiment of a press section of a papermaking machine for pressing and dewatering a paper web, likewise containing first and second press locations.

With respect to the modified exemplary embodiment of press section 100A depicted in FIG. 2, the operationally reliable transfer of the paper web PW between the first press location 1 and the second press location 2 is ensured by a suction box 16. This suction box 16 exerts a negative pressure or vacuum action from above the upper felt 13 upon such upper felt 13, and thus, retains the paper web PW situated therebelow against this upper felt 13. From the location of the suction box 16 the paper web PW arrives together with the upper felt 13 at the second press location 2. Instead of using the suction box 16, it would be possible to also provide a special, for instance, slotted blow box, schematically represented in broken lines by reference numeral 110. This slotted blow box 110 operates according to the injector principle and produces an air current or flow through narrow slots having a flow direction extending away from the upper felt 13, and thus, exerts a retaining force or adhering action upon the paper web PW. Such a slotted blow box 110 also can be provided for the suction box 16 cooperating with the further upper looped or endless felt or felt belt 14 with which coacts the web removal or pickup device 18.

Figure 3:
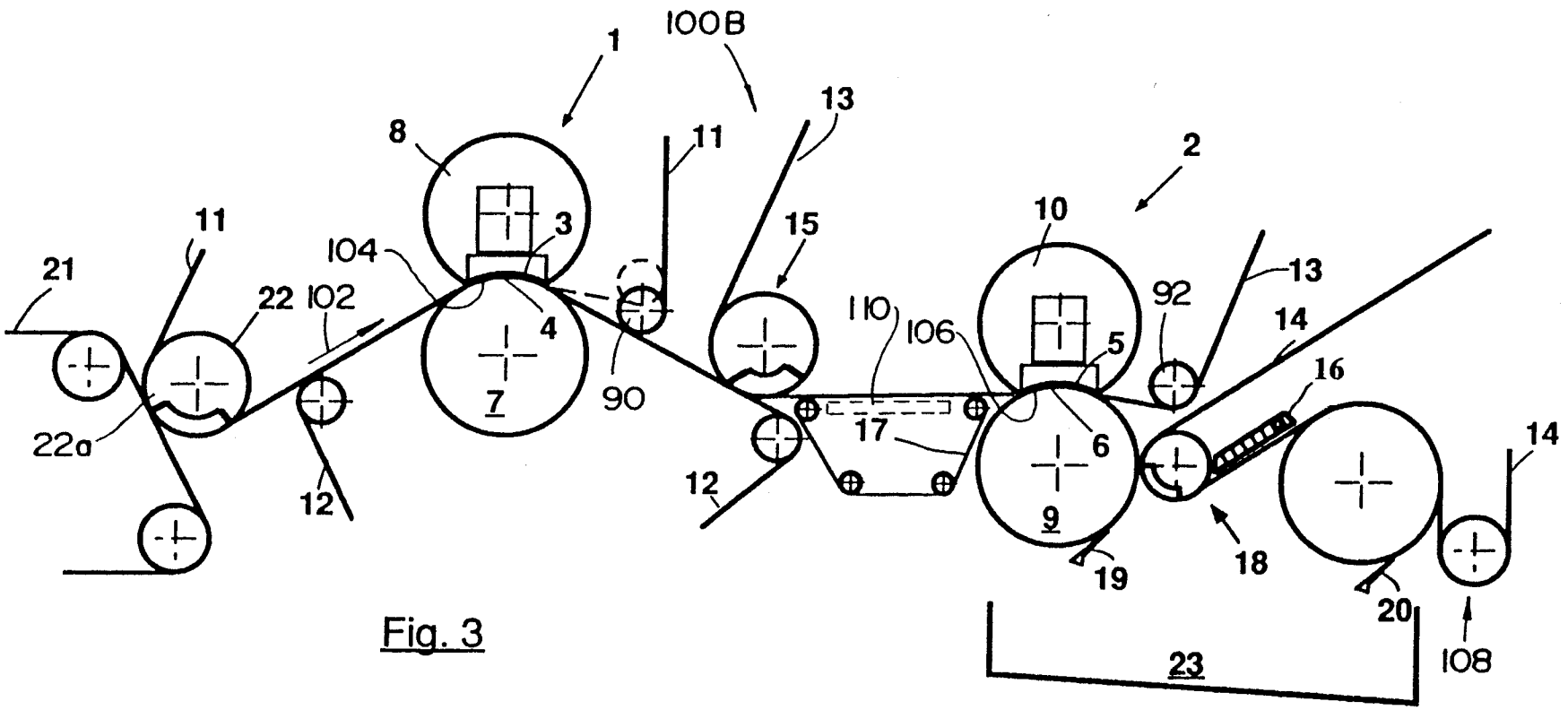
FIG. 3 is a schematic side view of a third exemplary embodiment of a press section of a papermaking machine for pressing and dewatering a paper web, again containing first and second press locations.

Another possible construction of press section 100B is depicted in FIG. 3, where, instead of or in addition to the suction box 16 located upstream of the second press location 2, there is used a transport or transfer wire 17 or the like which presses the paper web PW from below against the upper felt 13. This modified construction also affords an operationally reliable transfer of the paper web PW between the first press location 1 and the second press location 2. A further advantageous constructional possibility, useful for the same purpose, would entail the use of a blow box beneath the paper web PW, again schematically represented by the broken or dashed lines 110.

Figure 4:
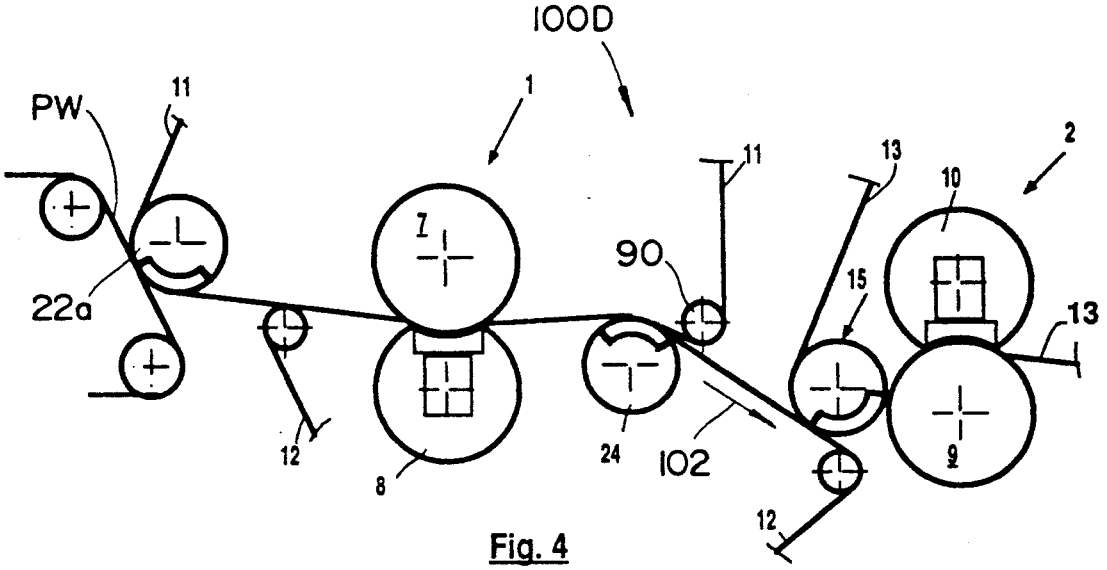
FIG. 4 is a schematic fragmentary side view of a fourth exemplary embodiment of a press section of a papermaking machine for pressing and dewatering a paper web, equally containing first and second press locations.

Apart from the different constructions of press sections 100, 100A and 100B, as respectively depicted and considered with respect to FIGS. 1 to 3, employing the upper situated extended nip press rolls 8 and 10 in the first press location 1 and the second press location 2, respectively, FIG. 4 depicts a variant construction of press section 100D employing an arrangement containing a lower situated extended nip press roll 8 arranged at the first press location 1 and on top of which there is arranged an upper counter roll 7. Similar to the previously considered embodiments, the paper web PW can be transferred by means of two looped or endless felts 11 and 12 from the first press location 1 and the upper looped or endless felt 11 can be raised or lifted away from the paper web PW. A suction roll 24 is mounted beneath the lower felt 12 to ensure for positive entrainment of the paper web PW. This solution can be advantageously combined with the different constructions previously discussed for transfer of the paper web PW to the second press location 2. In the depicted arrangement there is shown, by way of example and not limitation, a web transfer structure composed of the web removal device 15 like that considered with regard to the prior discussion of the embodiment of FIG. 1. Here also, the successively arranged first press location 1 and the second press location 2 are shown, by way of example, positioned at substantially the same elevation or height.

Figure 5:
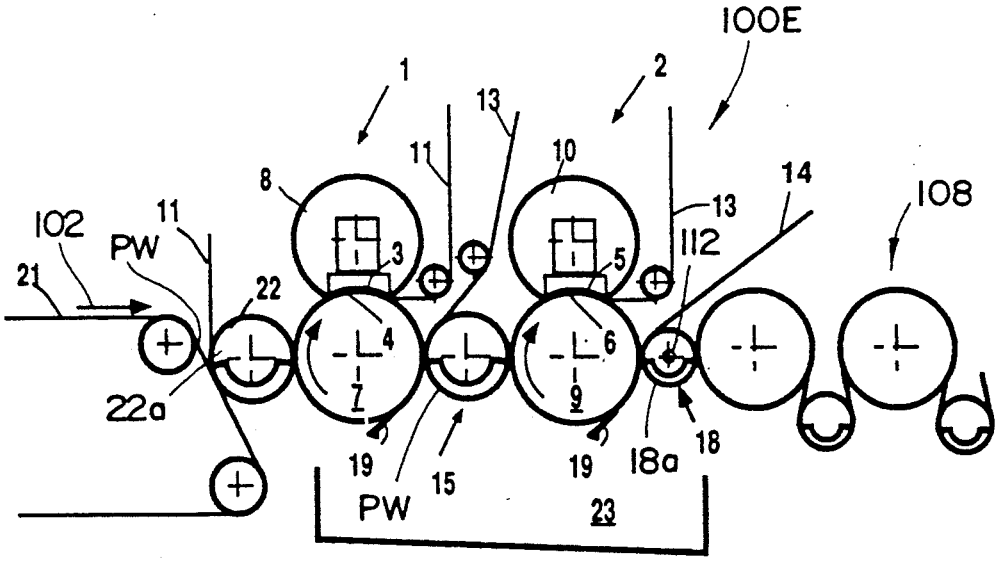
FIG. 5 is a schematic fragmentary side view of a fifth exemplary embodiment of a press section of a papermaking machine for pressing and dewatering a paper web, once again containing first and second press locations.

FIG. 5 depicts a further construction of press section 100E according to the present invention. There is illustrated therein an exceedingly compact arrangement of the entire press section 100E. The web removal device 15, operated under vacuum or suction conditions, directly transfers the paper web PW from the lower counter roll 7 belonging to the first press location 1 to the lower counter roll 9 belonging to the second press location 2. After travel through the second press location 2 the paper web PW remains at the lower counter roll 9 until reaching the further web removal or pickup device 18, here constructed, for instance, as a suction roll 18*a*, whereas the upper felt 13 is picked-off or removed from the paper web PW immediately after emerging from the extended press surfaces 5 and 6. This further web removal or pickup device 18 directly delivers or transfers the paper web PW to the subsequently situated drying section 108. Moreover, such additional web removal device 18, which cooperates with the further upper felt 14, is advantageously mounted to be pivotable towards and adjustable in position with respect to the lower counter roll 9, for which purpose there can be used any suitable roll pivot structure as schematically represented by reference numeral 112. Additionally, the drying section 108 can be structured to provide a continuous closed guidance or closed draw guidance of the paper web through such drying section. Once again, it is possible for the successively arranged first press location 1 and the second press location 2 to be positioned at substantially the same elevation or height.

While there are shown and described present preferred embodiments of the invention, it is distinctly to be understood the invention is not limited thereto, but may be otherwise variously embodied and practiced within the scope of the following claims.

What is claimed is:

1. A press section of a papermaking machine for dewatering a paper web, comprising:

means for providing two separate successively arranged press locations defining a first press location containing an extended nip and a second press location containing an extended nip through which travels a paper web in a predetermined direction of travel;

at least one separate felt provided for the first press location and guided in conjunction with the paper web through the first press location;

at least one separate felt provided for the second press location and guided in conjunction with the paper web through the second press location;

said means providing the second press location containing a substantially cylindrical counter roll which defines a lower counter roll extending beneath the second press location and an extended nip press roll extending above the second press location;

said extended nip press roll forming the extended nip of the second press location and being essentially accommodated to the contour of the counter roll;

a web removal device operated under vacuum conditions arranged downstream of the first press location and in contact with said lower counter roll via said at least one separate felt provided for the second press location, and transfers the paper web into contact with said lower counter roll of the second press location to practically preclude dropping of the paper web;

the paper web being guided from the first press location to said web removal device;

said at least one separate felt provided for the second press location defining an upper felt guided in conjunction with the paper web through the second press location; and the paper web being contacted by said upper felt of the second press location and being transported by said upper felt from said web removal device to the second press location, while being practically precluded from dropping, due to the weight of the paper web, from said upper felt of the second press location, by said arrangement of said web removal device with respect to the second press location.

2. The press section of a papermaking machine for dewatering a paper web according to claim 1, wherein:

the at least one separate felt provided for the first press location and guided in conjunction with the paper web through the first press location defines a lower felt; and the paper web being transferred by the lower felt of the first press location to the vacuum-operated web removal device which is contacted by the upper felt of the second press location.

3. The press section of a papermaking machine for dewatering a paper web according to claim 1, wherein said at least one separate felt provided for the first press location comprises an upper felt provided for the first press location, and said web removal device directly removes the paper web from the first press location.

4. The press section of a papermaking machine for dewatering a paper web according to claim 3, wherein:

the means providing the first press location comprising a lower counter roll provided for the first press location; and the web removal device directly removing the paper web from the lower counter roll.

5. The press section of a papermaking machine for dewatering a paper web according to claim 3, further including:

means arranged downstream of the first press location for removing the upper felt from the paper web in order to prevent rewetting the paper web.

6. The press section of a papermaking machine for dewatering a paper web according to claim 1, further including:

an additional web removal device arranged downstream of the second press location with respect to the predetermined direction of travel of the paper web;

a further upper felt cooperating with the additional web removal device;

a suction box operated under vacuum conditions arranged above the further upper felt; and said additional web removal device guiding the paper web, following the second press location, at the further upper felt such that the suction box retains the paper web against the further upper felt.

7. The press section of a papermaking machine for dewatering a paper web according to claim 1, further including:

an additional web removal device arranged downstream of the second press location with respect to the predetermined direction of travel of the paper web;

a further upper felt cooperating with the additional web removal device;

a blow box arranged above the further upper felt;

the blow box directing an air current in a direction away from the further upper felt; and said additional web removal device guiding the paper web, following the second press location, at the further upper felt such that the blow box retains the paper web against the further upper felt.

8. The press section of a papermaking machine for dewatering a paper web according to claim 6, wherein:

the blow box comprises a slotted blower box for producing an injector action which directs the air current in the direction away from the further upper felt.

9. The press section of a papermaking machine for dewatering a paper web according to claim 1, wherein:

the first press location contains a substantially cylindrical counter roll extending beneath the first press location and an extended nip press roll extending above the first press location; and the extended nip press roll forming the extended nip of the first press location and being essentially accommodated to the contour of the substantially cylindrical counter roll of the first press location.

10. The press section of a papermaking machine for dewatering a paper web according to claim 1, wherein:

the successively arranged first press location and second press location are positioned at substantially the same elevation.

11. The press section of a papermaking machine for dewatering a paper web according to claim 1, further comprising:

an additional web removal device arranged downstream of the second press location with respect to the predetermined direction of travel of the paper web;

means for providing a web drying section arranged downstream of the additional web removal device;

a further upper felt cooperating with the additional web removal device;

said upper felt of the second press location being guided, following passage through the second press location, such that it detaches from the paper web which remains adhering to the lower counter roll; and said additional web removal device removing the paper web from the lower counter roll and transferring the removed paper web to the drying section.

12. The press section of a papermaking machine for dewatering a paper web according to claim 11, wherein:

the additional web removal device cooperating with the further upper felt; and means for mounting the additional web removal device to be pivotable towards and adjustable in position with respect to the lower counter roll.

13. The press section of a papermaking machine for dewatering a paper web according to claim 11, wherein:

the drying section provides a continuous closed guidance of the paper web through the drying section.

14. The press section of a papermaking machine for dewatering a paper web according to claim 1, further including:

broke pulper means arranged beneath the second press location for collecting and forming a suspension therein of broke formed upon tearing or transfer of the paper web.

15. The press section of a papermaking machine for dewatering a paper web according to claim 1, wherein:

the press section is devoid of means upstream of the second press location for forming transfer tails, so that transfer of the paper web through the first press location and the second press location occurs throughout the full width of the paper web.

16. The press section of a papermaking machine for dewatering a paper web according to claim 1, wherein said web removal device is located in contact with said means for defining a first press location via said upper felt.

17. A press section of a papermaking machine for dewatering a paper web, comprising:

means for providing two separate successively arranged press locations defining a first press location and a second press location through which travels a paper web in a predetermined direction of travel;

each of said first and second press locations comprising an upper extended press surface and a lower extended press surface forming therebetween an extended press nip at each said first and second press locations;

at least one felt provided for the first press location and guided in conjunction with the paper web through the first press location;

at least one further felt provided for the second press location and guided in conjunction with the paper web through the second press location;

the second press location containing a substantially cylindrical counter roll and an extended nip press roll cooperating with said substantially cylindrical counter roll;

said extended nip press roll forming the extended nip of the second press location and being essentially accommodated to the contour of said counter roll;

means cooperating with at least one of said at least one felt provided for the first press location for separating said at least one of said at least one felt provided for the first press location from the paper web located beneath said at least one of said at least one felt provided for the first press location at a location downstream of the first press location, as viewed in the predetermined direction of travel of the paper web;

a web removal device operated under vacuum conditions arranged downstream of the first press location and directly adjacent the second press location to practically preclude dropping of the paper web;

the paper web being guided from the first press location to the web removal device;

said at least one further felt provided for the second press location defining an upper felt guided in conjunction with the paper web through the second press location; and the paper web being contacted by said upper felt of the second press location and being transported by said upper felt of the second press location from said web removal device to the second press location, while being practically precluded from dropping, due to the weight of the paper web, from said upper felt of the second press location, by said arrangement of said web removal device with respect to the second press location, wherein said web removal device is located in contact with said substantially cylindrical counter roll via said upper felt.

18. The press section of a papermaking machine for dewatering a paper web according to claim 17, wherein said web removal device is located in contact with said means for defining a first press location via said upper felt.

* * * * *